US005108217A

United States Patent [19]

Bloom

[11] Patent Number: 5,108,217

[45] Date of Patent: Apr. 28, 1992

[54] SELF-RESTORING CHANNELIZING DEVICE

[75] Inventor: Jeffrey A. Bloom, Silver Spring, Md.

[73] Assignee: Adian Engineering Corporation, Silver Spring, Md.

[21] Appl. No.: 534,570

[22] Filed: Jun. 6, 1990

Related U.S. Application Data

[63] Continuation-in-part of Ser. No. 390,311, Aug. 7, 1989, abandoned.

[51] Int. Cl.[5] ..... E01F 9/00

[52] U.S. Cl. ..... 404/10

[58] Field of Search ..... 404/9, 10, 12–14, 404/16; 156/71, 294–295

[56] References Cited

U.S. PATENT DOCUMENTS

| | | | |
|---|---|---|---|
| 2,333,273 | 11/1943 | Scanlon | 404/10 |
| 3,380,428 | 4/1968 | Abrams | 404/10 |
| 3,596,628 | 8/1971 | Wright | 404/9 |
| 3,851,616 | 12/1974 | Brown | 404/10 |
| 4,373,464 | 2/1983 | Blau | 404/10 |
| 4,511,281 | 4/1985 | Schmanski | 404/10 |
| 4,514,125 | 4/1985 | Stol | 156/294 |
| 4,611,949 | 9/1986 | Schmanski | 404/10 |

*Primary Examiner*—Ramon S. Britts
*Assistant Examiner*—Roger J. Schoeppel
*Attorney, Agent, or Firm*—David B. Newman, Jr.

[57] ABSTRACT

A highway self-restoring channelizing device that is placed along the traveled way to guide motorists through temporary construction zones. The self-restoring channelizing device comprises a foam rubber body encased in a reinforced rubber outer casing that is attached to a rigid base. The base is in turn adhered or anchored to highway pavement. The self-restoring channelizing device has a shape that when viewed in elevation from the side has a wide base sloping upward to a narrow almost vertical upper portion. When viewed from the direction of traffic the self-restoring channelizing device has a tall rectangular shape. The self-restoring channelizing device will not displace and immediately restores to its original shape when impacted or run-over by a vehicle. The self-restoring channelizing device is quickly adhered to pavement and can be removed using a scraper type tool.

24 Claims, 6 Drawing Sheets

SELF-RESTORING CHANNELIZING DEVICE

This application is a continuation-in-part of application Ser. No. 07/390,311 filed Aug. 7, 1989, now abandoned.

BACKGROUND OF THE INVENTION

This invention relates to highway channelizing devices that are placed along the traveled way to guide motorists through temporary construction zones, and more particularly, to a synthetic foam rubber bodied device reinforced by a textile outer casing that is attached to a base. The outer casing may be coated with an elastomer coating. The base is in-turn adhered to, anchored to, or ballasted against highway pavement. The device will not displace and immediately restores to its original shape when impacted or run-over by a vehicle.

DESCRIPTION OF THE PRIOR ART

Channelizing devices are placed along highways to act as visual guides or delineators to guide traffic through construction or other temporary zones. Channelizing devices can be continuous or intermittent. Examples of continuous channelizing devices include raised curbs and painted lines. Intermittent channelizing devices in previous use consist of cones, drums, barricades, vertical tubes, etc.

Channelizing devices can be used to form a visual barrier that separates two opposing lanes of traffic. The height and barrier-like appearance of channelizing devices indicate to motorist that two-lane, two-way operations (TLTWO) is in effect. TLTWO is a traffic control technique used during rehabilitation of divided highways. One side of the road is closed for repairs and the other set up as a TLTWO. In this type of work situation, temporary crossovers are built at the ends of the construction zone to route one direction of traffic over to the corresponding lane of the other side of the divided roadway. Channelizing devices are essential for clearly indicating that crossover to the other lane is forbidden along the many miles of construction, where drivers might otherwise become confused.

The major problem with previous intermittent channelizing devices is that they require extensive maintenance to keep the roadway well marked along the entire construction zone. Channelizing devices are often impacted because drivers wander across the centerline, try to pass, or purposely hit the devices as a game. Expensive positive barriers, such as portable concrete median barriers, placed along many miles of low density highway, cannot be cost justified on the majority of the rural highways and low density roads. Hence, low cost intermittent channelizing devices are used.

The maintenance problem with previous channelizing devices occurs when they are impacted by vehicles and knocked off the roadway because of passing, inattention, loss of control or vandalism. Most previous devices are held in place only by their own weight or by use of sandbags. In addition, most previous devices do not have an ability to self-restore to their original shape when run-over by vehicles. The previous designs for channelizing devices exhibit one or more of the following problems:

- The device is easily displaced because it is not anchored,

- The anchorage is inadequate to resist vehicle or wind forces,
- The device does not self-restore following impact,
- The device is poorly visible due to size,
- The device is a hazard if hit,
- The device is difficult and dangerous to replace during active traffic conditions.

The intermittent self-restoring anchored channelizing device described herein overcomes these problems.

OBJECT AND SUMMARY OF THE INVENTION

An object of the present invention is to provide a self-restoring channelizing device which visually directs traffic through temporary construction zones during highway repair and rehabilitation operations.

Another object of the present invention is to provide a self-restoring channelizing device that will not be displaced when impacted by vehicles.

An additional object of the present invention is to provide a self-restoring channelizing device that can be easily adhered to pavement and will remain adhered for several months.

Another object of the present invention is to provide a lightweight self-restoring channelizing device that will not pose a safety threat to motorists if displaced and thrown against the windshield.

A further object of the present invention is to provide a self-restoring channelizing device that will self-restore to its original configuration after being impacted or run-over by a vehicle.

A still further object of the present invention is to provide a large, highly visible marker for enhanced motorist response.

According to the present invention, as embodied and broadly described herein, a self-restoring channelizing device is provided comprising base means. a body, casing means and coating means. The base means, casing means and coating means may be embodied as a base, a case, and coating, respectively.

When viewed from the side, the body has an original shape, similar to a flask with a lower portion that follows a curved shape of decreasing width with height, this shape being mirrored on both sides of the vertical centerline, and an upper portion more narrow than the lower portion with nearly vertical faces. When viewed from the direction parallel to traffic the device has a tall rectangular shape. The body, which may be constructed from a foamed flexible elastomer, deforms from impact from a vehicle and restores by expanding to the original shape after the impact. The base has means for attaching to pavement. The base also includes members with a shape for attaching the body. The casing, which may be made from a synthetic textile fabric, covers the body and secures the body to the base. A coating which is made from an elastomer may cover the body and casing and provide abrasion protection, weather protection and color.

Additional objects and advantages of the invention will be set forth in the description which follows, and in part will be obvious from the description, or may be learned by practice of the invention.

BRIEF DESCRIPTION OF THE DRAWINGS

The accompanying drawings, which are incorporated in and constitute part of this specification, illustrate a preferred embodiment of the invention, and together with the description, serve to explain the principles of the invention.

DETAILED DESCRIPTION OF THE PREFERRED EMBODIMENTS

Reference will now be made to the present preferred embodiments of the invention, examples of which are illustrated in the accompanying drawings.

Figure 1:
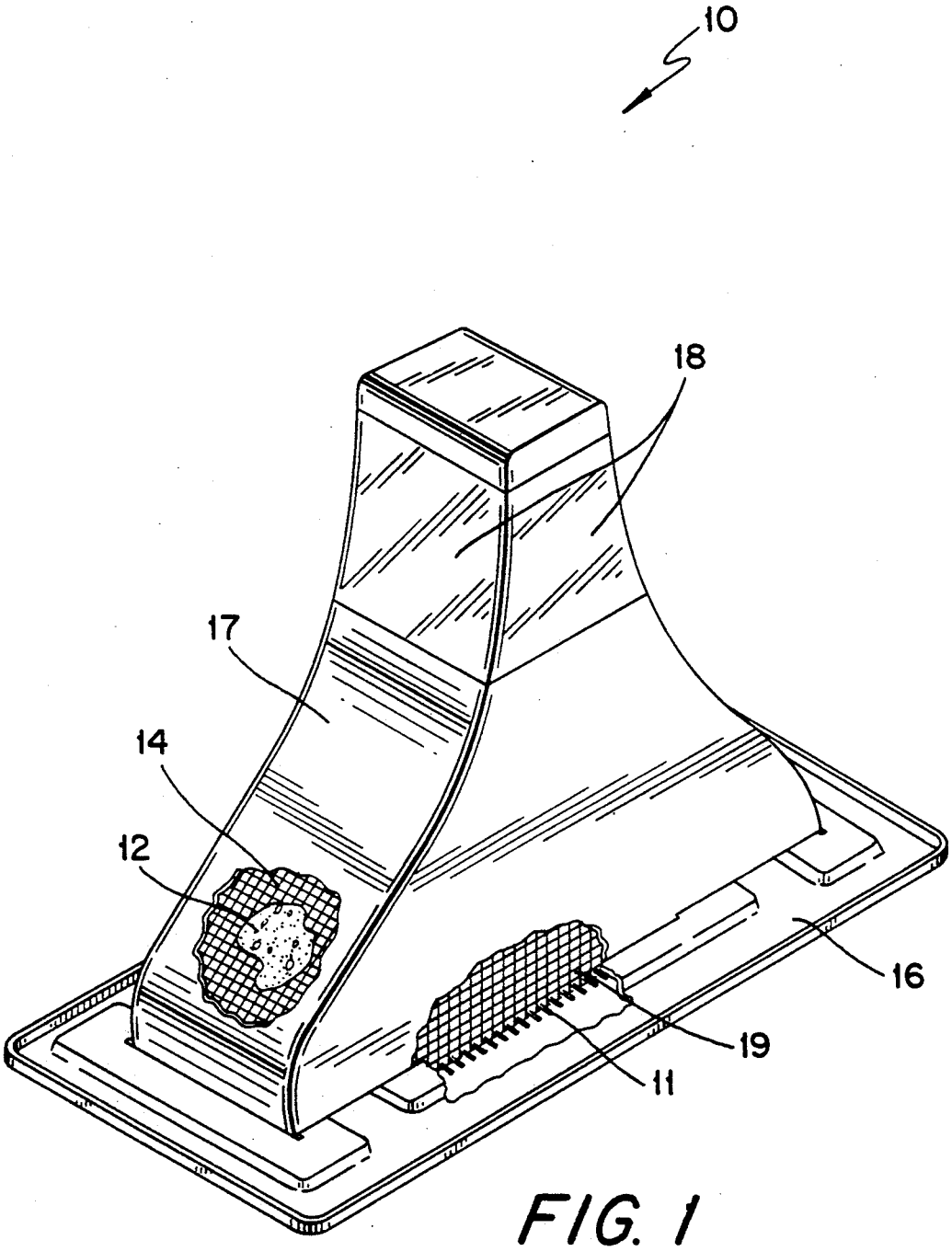
FIG. 1 shows a self-restoring channelizing device of general configuration and shape.

As illustratively shown in FIG. 1, a self-restoring channelizing device 10 includes body means, a base 16, casing means and coating means. The body means and casing means may be embodied as a body 12 and a casing 14. The coating means may be embodied as coating 17. The body 12 maybe made from a flexible foam elastomer, and the casing 14 may be made from a textile fabric. The coating 17 may be made from an elastomer. Also shown on the vertical faces of the device is retro-reflective material 18. The base 16 includes slots for the insertion of the fabric casing ends 19 and fabric retainers 11 for holding the fabric in the base.

Figure 2:
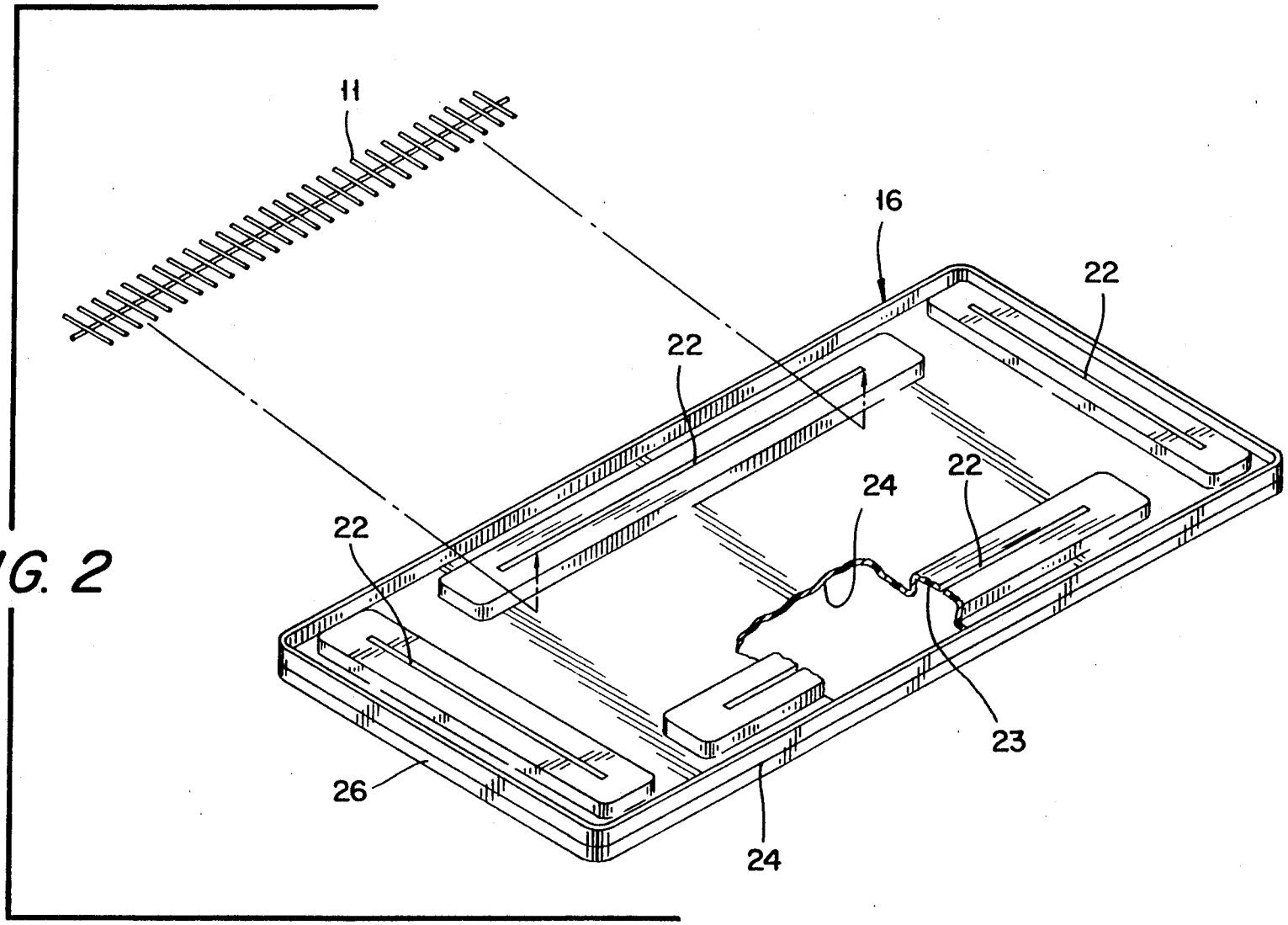
FIG. 2 shows a base for adhesion or mechanical fastening to pavement.

In the exemplary arrangement shown in FIG. 2, a base 16 is shown with slots 22 and raised cavities 23 for holding the fabric retainers 11. When fabric retainers 11 are in place in the raised cavity 23, they become an integral part of the base. The means for attaching to a pavement may be embodied as a flat surface area 24 and an adhesive base pad 26 for adhesive bonding. The base, as shown in FIG. 2, may be manufactured from a semi-rigid plastic. The fabric retainers 11 are comb-like devices whose teeth fit into the open weave of the fabric casing.

Figure 3:
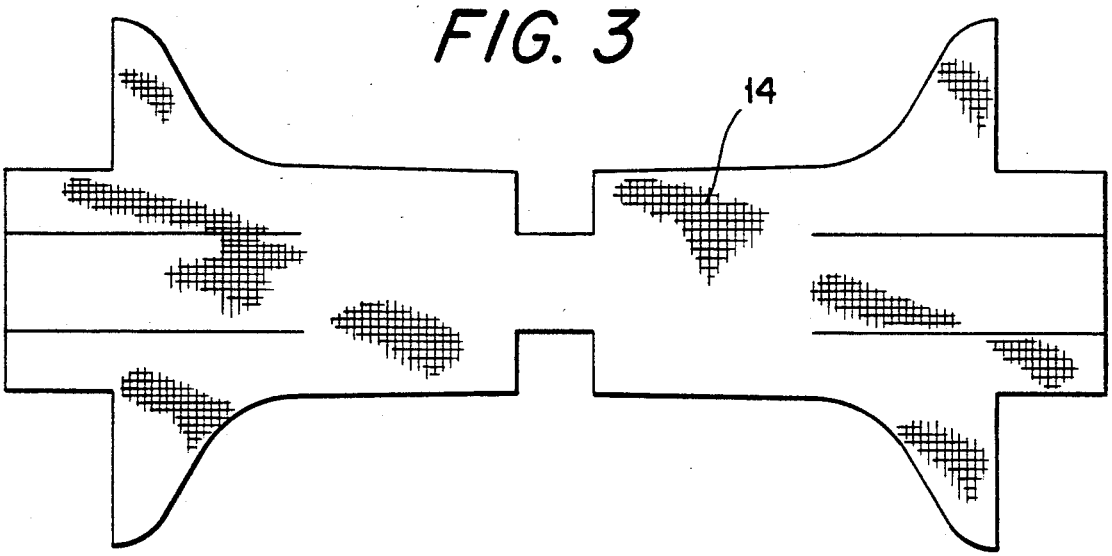
FIG. 3 shows a general shape of the reinforcing fabric panels in the casing after cutting and prior to installation onto the device.

FIG. 3 depicts a fabric panel 14, which may be used in the, casing for covering the body 12 of FIG. 1. The fabric panel 14, is also for securing the body to the base. As shown in FIG. 3, the fabric panel is depicted as a cut panel for the outer casing. The fabric panel is overlapped on the body 12 of FIG. 1.

Figure 4B:
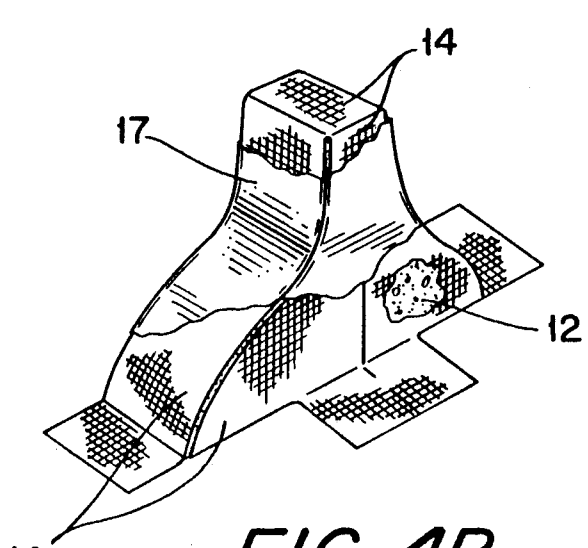
FIG. 4B shows a textile fabric for the casing over the foamed elastomer body prior to coating with elastomer coating.
Figure 4A:
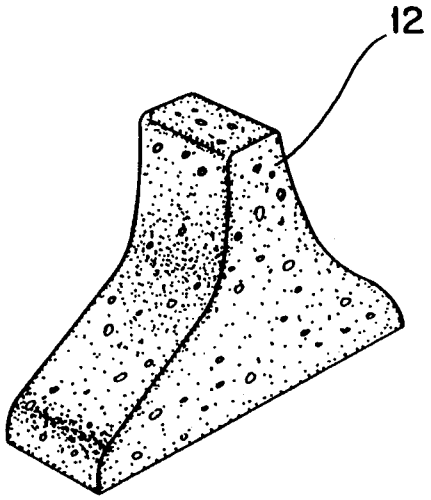
FIG. 4A shows the foamed elastomer body.

FIG. 4A shows a body 12 which may be manufactured from foamed elastomer. The body, as shown in FIG. 4A, is in an original shape that is similar to a flask when viewed from the side. When viewed from the side, the body 12 has a lower portion that, in a vertical direction, follows a curve of decreasing width with height. The shape is mirrored on both sides of the vertical centerline, with a more narrow upper portion with nearly vertical faces. The body 12 is flexible and flexes from impact from a vehicle and restores to the original shape after the impact expansion of the foamed elastomer.

FIG. 4B shows the reinforcing fabric for the casing 14 being placed over the body 12. As shown in FIG. 4B, the casing 14 may be made from a textile fabric placed over a foamed elastomer body 12 and coated with an elastomer coating 17. In a preferred embodiment, the reinforcing textile fabric casing 14 is placed into the mold prior to forming the body in that mold. The elastomer coating may be spread, brushed or placed onto the body and casing, by dipping the body and casing into a vat of liquid elastomer.

Figure 5B:
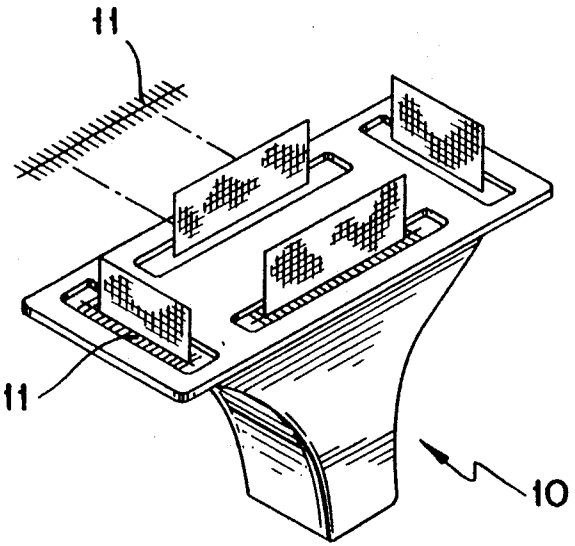
FIG. 5B shows the fabric retainer that holds the fabric into the base.
Figure 5A:
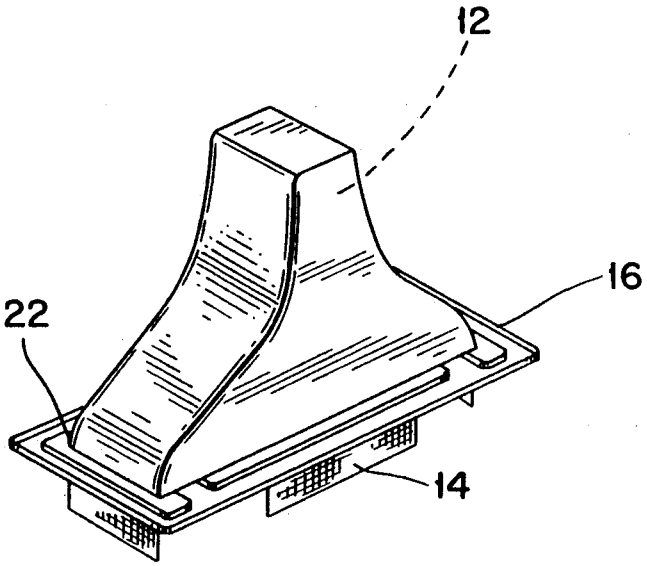
FIG. 5A shows the placement of the body and casing onto the base.
Figure 7A:
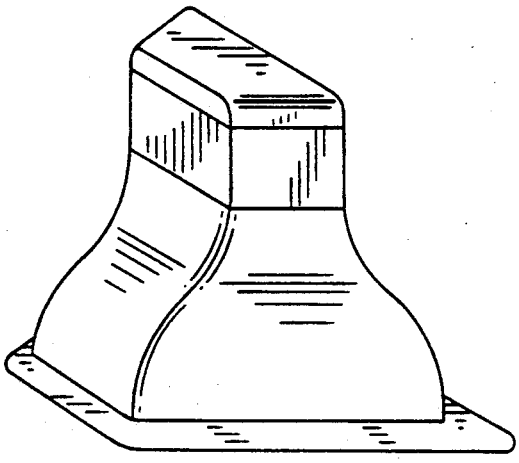
FIG. 7A shows a trapezoidal configuration and shape of the self-restoring channelizing device.
Figure 7B:
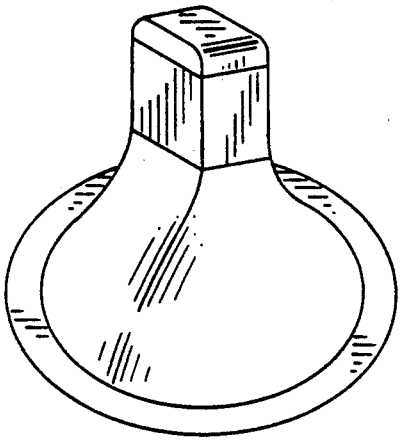
FIG. 7B shows a circular configuration and shape of the self-restoring channelizing device.
Figure 7C:
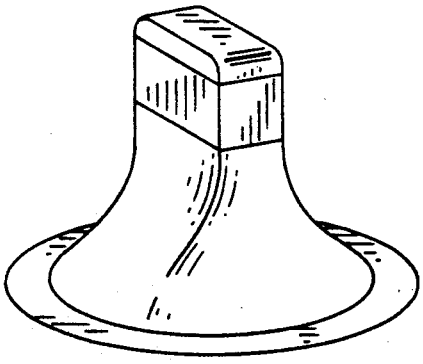
FIG. 7C shows an oval configuration and shape of the self-restoring channelizing device.
Figure 7D:
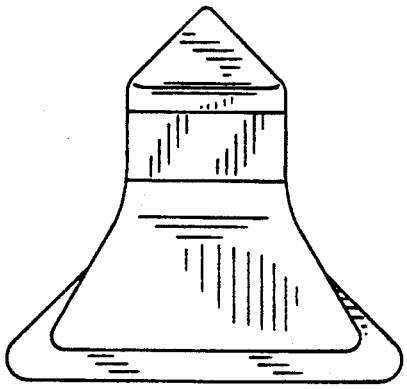
FIG. 7D shows a triangular configuration and shape of the self-restoring channelizing device.

FIG. 5A shows a body 12 placed on top of base 16, with a casing 14 covering the body and going though the slots 22 in the base. FIG. 5B shows an assembled self-restoring channelizing device 10 with fabric retainers 11 placed into raised cavities in the base from the underside of the base and the teeth of the retainers placed into the open weave of the fabric casing ends.

Figure 6:
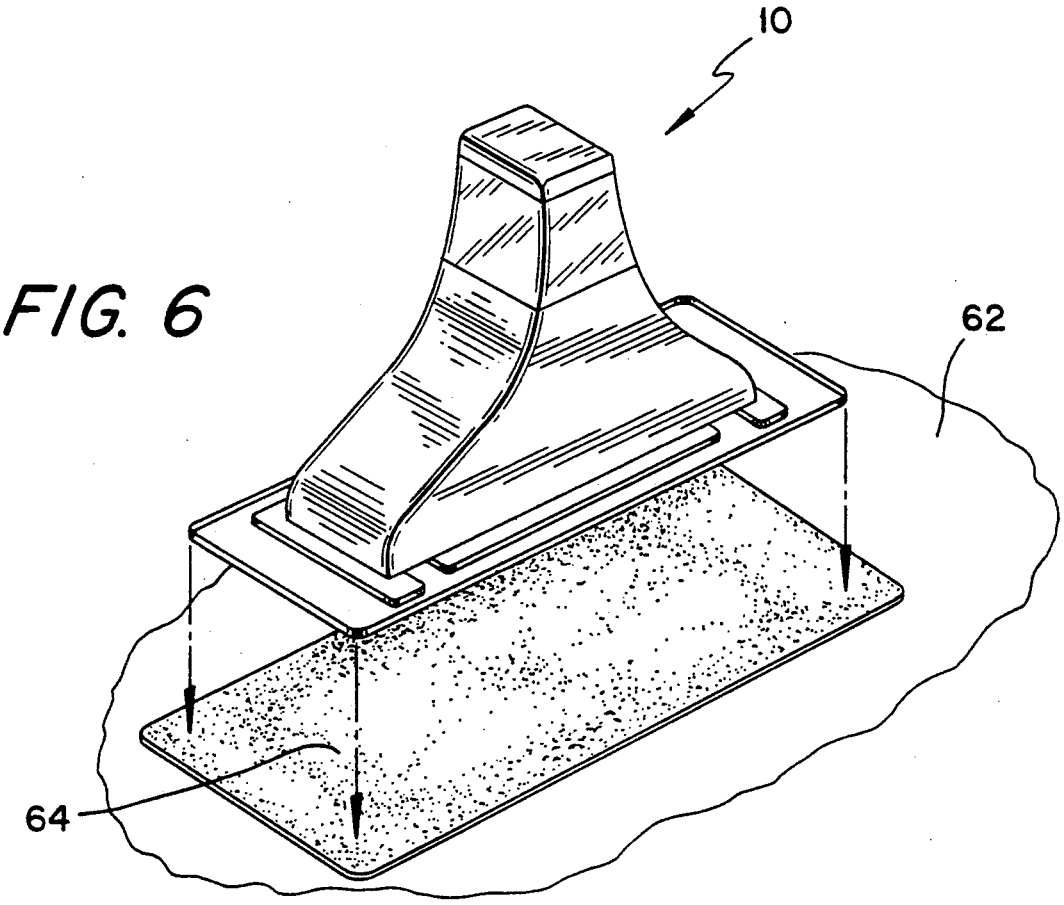
FIG. 6 shows the self-restoring channelizing device being adhered to the pavement using a heated adhesive base pad.

FIG. 6 shows the self-restoring channelizing device 10 being adhered to the pavement 62 by use of an adhesive base pad 64 that is heated prior to placement of the self-restoring channelizing device base onto the base pad. The adhesive base pad 64 may be made from an asphaltic material that becomes somewhat liquid when heated.

FIGS. 7A, 7B, 7C, and 7D show various modifications, including trapezoidal, circular, oval and triangular, that can be made regarding the configuration and shape of the self-restoring channelizing device. These configurations and shapes are not exclusive, but only illustrate some of the options available to achieve the desired properties of the device within the spirit and scope of the invention.

The self-restoring channelizing device may include a foamed elastomer body covered by a textile fabric casing which is in turn connected to the base. The base is adhered or mechanically anchored to pavement. A particular embodiment of the self-restoring channelizing device may be approximately 28 inches tall, 8 inches wide, and 24 inches long. Any size device, however, may be constructed according to the present invention.

The self-restoring channelizing device has a shape which starts with a base that is rectangular in plan view. Two body faces slope upward from the most widespread sides of the base along curved slopes toward the center until they reach a point near center where the slopes change to almost vertical. Thus, in elevation when viewed from the side, the device has a flask-like shape; the lower portion follows a shape that curves toward the vertical centerline with height, while the upper portion is narrow and almost vertical, as shown in FIG. 1. When viewed in elevation from the other direction, the direction seen by traffic, the self-restoring channelizing device has a tall rectangular shape. Other shapes are also possible using the materials and fabrication techniques according to the present invention.

The body of the self-restoring channelizing device is fabricated from flexible closed or open cell elastomeric plastic or rubber foams of various compositions and densities. The flexible foam forms the body of the device and gives it flexibility and self-restoring properties. Self restoration is the ability to return to the original shape and configuration without assistance and quickly after being run-over and flattened against the pavement.

The self-restoring properties are derived from the combination from the large elastic range of elastomers and the compression of the gas contained in the cells of the foam. For tensile strength and abrasion resistance, the foam is contained within a casing made from a reinforcing textile fabric and may be coated with an elastomer coating.

The self-restoring channelizing device incorporates a base with surfaces for adhesion or mechanical anchoring to pavement, as shown in FIG. 2. The base may be a separate component that is connected to the casing or may be integral with the casing. In the preferred embodiment, the base is made from semi-rigid plastic and contains means for holding the reinforcing textile fabric.

In the preferred embodiment, the self-restoring channelizing device casing fabric is made from cut open weave textile fabric the pattern for which is shown in FIG. 3. The reinforcing fabric is placed over the foam elastomer body seen in FIG. 4A. The self-restoring channelizing device may be dipped into or sprayed with rubber or other liquid elastomer after completion of the fabrication process. Other means of assembly are also possible so long as they achieve the desired properties of the device.

For adhering the device to pavement, the base of the self-restoring channelizing device may be placed onto a heated adhesive base pad made from an asphaltic material that becomes semi-liquid when heated. Upon cooling, the base pad adheres to the pavement and the base.

The casing of the self-restoring channelizing device is connected to a base for attachment to the pavement. The base can be a flat plate, a molded shape, an extrusion or a thermoformed shape. It is designed to be attached to the pavement using either adhesives or mechanical fasteners. A heavier base can also be employed to allow the self-restoring channelizing device to be free standing when pavement attachment is not desired. The base may also be molded from rubber or elastomeric plastic and may also be integral with the casing.

The self-restoring channelizing device may be held to the pavement by separate clamps which capture a portion of the channelizing device and hold it against the pavement The clamps may be attached to the pavement by use of an adhesive, fastener or any other technique that is applicable to pavement attachment.

Removal of the self-restoring channelizing device from the pavement may be accomplished using a scraper type device which is wedged between the base and the pavement and breaks the adhesive bond.

For night and bad weather delineation, retroreflective material is attached to one or more faces of the device The device can be fabricated in a variety of colors including, orange, red, yellow and white. Color may be added to the foamed elastomer body or textile fabric casing instead of using the elastomer coating.

Any combination of parts made from flexible foam and other materials that yields the desired behavior is applicable to this concept.

The self-restoring channelizing device is used as a guide or delineator on roadways or other paved surfaces. It may be used to mark center lines during construction projects where two-way traffic on a two lane roadway is used. The self-restoring channelizing device also can be used for a variety of other traffic control and traffic channelizing purposes. The self-restoring channelizing device serves as a clear marker to warn motorists of the dangers in crossing the centerline, road edge, lane divider, etc. To prevent displacement of the self-restoring channelizing device when impacted by a vehicle, it is designed for adhesive or mechanical anchor attachment to the pavement. It may also be used free-standing by the addition of a ballasted base. To insure that the device is still operational after being impacted by a vehicle, it is designed to be crushed flat and return to its original configuration in a few seconds. To prevent damage to vehicles in the event that the device should become dislodged from the pavement, it is designed to be light weight without a ballasted base.

It will be apparent to those skilled in the art that various modifications can be made to the self-restoring channelizing device of the instant invention without departing from the spirit or scope of the invention, and it is intended that the present invention cover modifications and variations of the self-restoring channelizing device provided they come within the scope of the appended claims and their equivalents.

I claim:

1. A self-restoring channelizing device comprising:

body means including a flexible material having an original shape with a lower portion almost triangular in shape, an upper portion more narrow and vertical than said lower portion as viewed from the side, and a bottom with a rectangular shape as viewed from the bottom, for flexing from impact from a vehicle and for restoring to the original shape after said impact;

a rigid base having a rectangular shape larger than the rectangular shaped bottom of said body means, with a rectangular area for inserting said body means, and having means for attaching with an adhesive material to a pavement; and casing means for covering said body means and for securing said body means to said base.

2. The self-restoring channelizing device as set forth in claim 1 wherein said body means includes a flexible foam material.

3. The self-restoring channelizing device as set forth in claim 1 wherein said casing means is reinforced by a textile material.

4. The self-restoring channelizing device as set forth in claim 1 wherein said base has peripheral slots for securing said casing means.

5. The self-restoring channelizing device as set forth in claim 4 wherein said securing means includes a spine with perpendicular teeth.

6. The self-restoring channelizing device as set forth in claim 1 wherein said attaching means includes an adhesive base pad made from asphaltic material that is heated onto pavement prior to placement of the self-restoring channelizing device onto the adhesive base pad.

7. A self-restoring channelizing device comprising:

body means including flexible material having an original shape with a lower portion and an upper portion, and a bottom, for flexing and allowing collapse upon impact from a vehicle and for restoring to the original shape after said impact;

a base having a shape larger than the bottom of said body means, with an area for inserting said body means for connecting said base to said body means, and having means for attaching to a pavement; and casing means having fabric for covering said body means and for securing said body means to said base.

8. The self-restoring channelizing device as set forth in claim 7, wherein the bottom of said body means has a trapezoidal shape and wherein said base has a trapezoidal shape larger than the trapezoidal shaped bottom of said body means, and has a trapezoidal shaped area for inserting said body means.

9. The self-restoring channelizing device as set forth in claim 7, wherein the bottom of said body means has a triangular shape and wherein said base has a triangular shape larger than the triangular shaped bottom of said body means, and has a triangular shaped area for inserting said body means.

10. The self-restoring channelizing device as set forth in claim 7, wherein the bottom of said body means has a circular shape and wherein said base has a circular shape larger than the circular shaped bottom of said body means, and has a circular shaped area for inserting said body means.

11. The self-restoring channelizing device as set forth in claim 7, wherein the bottom of said body means has a rectangular shape and wherein said base has a rectangular shape larger than the rectangular shaped bottom of said body means, and has a rectangular shaped area for inserting said body means.

12. The self-restoring channelizing device as set forth in claim 7, wherein the bottom of said body means has a oval shape and wherein said base has an oval shape larger than the oval shaped bottom of said body means, and has a oval shaped area for inserting said body means.

13. A self-restoring channelizing device comprising:

body means including flexible material having an original shape when viewed from the side, with a lower portion that follows a curved shape of decreasing width with height, said original shape being mirrored on both sides of a vertical centerline, an upper portion more narrow than said lower portion with nearly vertical faces, and a cross-section with a rectangular shape in plan view, for flexing from impact from a vehicle and for restoring to the original shape after said impact;

casing means for covering and reinforcing said body means; and a base having a rectangular shape larger than the rectangular shaped bottom of said body means, with slots for inserting said casing means, and having means for attaching with an adhesive to a pavement.

14. The self-restoring channelizing device as set forth in claim 13 wherein said body means includes a flexible foam material.

15. The self-restoring channelizing device as set forth on claim 13 wherein said casing means is made from a textile fabric material.

16. The self-restoring channelizing device as set forth in claim 13 wherein said body and casing are coated with a flexible coating.

17. A self-restoring channelizing device comprising:

body means including a flexible material having an original shape with a lower portion and an upper portion, and a bottom, for flexing and allowing collapse upon from impact from a vehicle and for restoring to the original shape after said impact;

a base having means for connecting said base to said body means, and for attaching to a pavement; and casing means having fabric for covering said body means and for securing said body means to said base.

18. The self-restoring channelizing device as set forth in claim 17, wherein the bottom of said body means has a trapezoidal shape and wherein said base has a trapezoidal shape larger than the trapezoidal shaped bottom of said body means, and has means for attaching to said body means.

19. The self-restoring channelizing device as set forth in claim 17, wherein the bottom of said body means has a triangular shape and wherein said base has a triangular shape larger than the triangular shaped bottom of said body means, and has means for attaching to said body means.

20. The self-restoring channelizing device as set forth in claim 17, wherein the bottom of said body means has a rectangular shape and wherein said base has a rectangular shape larger than the rectangular shaped bottom of said body means, and has means for attaching to said body means.

21. The self-restoring channelizing device as set forth in claim 17, wherein the bottom of said body means has a oval shape and wherein said base has a oval shape larger than the oval shaped bottom of said body means, and has means for attaching to said body means.

22. The self-restoring channelizing device as set forth in claim 17 wherein said body means includes a flexible foam material which will allow the body to collapse and to then self-restore following an impact.

23. The self-restoring channelizing device as set forth in claim 17 wherein said casing means is made from a textile material.

24. The self-restoring channelizing device as set forth in claim 17 wherein said body and casing are coated with a flexible coating.

* * * * *